US006557441B1

(12) United States Patent
Brihier

(10) Patent No.: US 6,557,441 B1
(45) Date of Patent: May 6, 2003

(54) ROTATIONAL DRIVING TOOL FOR SCREWING MEMBER

(75) Inventor: Gérard Charles Camille Brihier, St Germain les Arpajon (FR)

(73) Assignee: Facom, Morangis (FR)

( * ) Notice: Subject to any disclaimer, the term of this patent is extended or adjusted under 35 U.S.C. 154(b) by 0 days.

(21) Appl. No.: 10/088,410

(22) PCT Filed: Sep. 1, 2000

(86) PCT No.: PCT/FR00/02427

§ 371 (c)(1),
(2), (4) Date: Mar. 20, 2002

(87) PCT Pub. No.: WO01/23145

PCT Pub. Date: Apr. 5, 2001

(65) Prior Publication Data

(65)

(30) Foreign Application Priority Data

Sep. 28, 1999 (FR) ..... 99 12086

(51) Int. Cl.[7] ..... B25B 13/52

(52) U.S. Cl. ..... 81/119; 81/64; 81/69; 81/90.1

(58) Field of Search ..... 81/119, 98, 99, 81/64, 3.4, 90.1, 65.2, 68, 69

(56) References Cited

U.S. PATENT DOCUMENTS 1,218,576 A * 3/1917 Norwood ..... 81/90.1
1,619,744 A * 3/1927 McCloskey ..... 7/100
2,594,154 A 4/1952 Greer et al.
2,886,998 A 5/1959 Scott
5,365,809 A * 11/1994 Hsiao ..... 81/176.1
5,464,421 A * 11/1995 Wortrich ..... 606/139
5,699,701 A * 12/1997 Cotten, Jr. ..... 81/119

FOREIGN PATENT DOCUMENTS

| | | |
|---|---|---|
| CH | 136845 | 11/1929 |
| FR | 530138 | 12/1921 |
| FR | 592653 | 8/1925 |
| GB | 618203 | 2/1949 |
| GB | 2219540 | 12/1989 |

* cited by examiner

*Primary Examiner*—Lee D. Wilson
*Assistant Examiner*—Hadi Shakeri
(74) *Attorney, Agent, or Firm*—Wenderoth, Lind & Ponack, L.L.P.

(57) ABSTRACT

A tool (1) comprising a head (4) having at least two engaging surfaces (10) for driving the screwing member by its at least partially matching shape and a device (5) for driving the head rotation. The head globally behaves as a single-piece part when the screwing member is driven in rotation. The head includes a zone (7) linking the engaging surfaces and parts (9) transmitting to the engaging surfaces a rotation force applied on the driving device. The linking zone is located between the force-transmitting parts and the engaging parts. The head is designed such that the action of the rotational driving device on the force-transmitting parts tends to deform the shape of the head so as to bring the engaging surfaces closer to each other when a rotational driving force is applied via the driving device on the screwing member. The present invention is, for example, applicable to flat open-end wrenches.

20 Claims, 3 Drawing Sheets

ROTATIONAL DRIVING TOOL FOR SCREWING MEMBER

BACKGROUND OF THE INVENTION

The present invention relates to a driving tool for turning a screwthreaded member, particularly a hand tool, of the type comprising a head having at least two contact surfaces for driving the screwthreaded member by at least partial complementarity of form, and driving means for turning the head. The head behaves overall as a single piece when turning a screwthreaded member. The head includes a connecting region between the contact surfaces and the parts that transmit, to the contact surfaces, a turning force applied to the driving means. The connecting region is situated between the force transmitting parts and the contact surfaces.

The present invention applies, for example, to flat open-ended wrenches.

The head of such a wrench has two rigid open jaws, each of which has a contact surface for a screwthreaded member such as a nut. The two contact surfaces are opposite each other.

When a wrench of this kind is used to transmit a turning force to a nut, the jaws deform in such a way that the contact surfaces move apart. The nut therefore turns relative to the jaws. This modifies the pressure points between the nut and the jaws such that the force vectors (which are theoretically parallel) corresponding to the turning force move toward each other. This means that, for a given turning force, the magnitude of the corresponding forces increases. This increase leads in turn to an increase in the bending of the jaws. The phenomenon is self-amplifying and, above a certain value, there is total rotation of the nut in the jaws, often with destruction of the latter. The nut can then be said to have become in effect a cam, causing the wrench to burst.

The phenomenon therefore limits the turning forces that can be transmitted by any such flat open-ended wrench. This phenomenon is present in a general way in tools in which, unlike vices, for example, the clamping force of the contact surfaces is not independent of the turning force.

It is an object of the present invention to solve this problem by providing a tool of the aforementioned type capable for example of exerting increased turning forces on a screwthreaded member.

SUMMARY OF THE INVENTION

To this end, the subject of the present invention is a tool of the aforementioned type, characterized in that the head is designed so that the action of the driving means on the force transmitting parts tends to deform the geometry of the head such that the contact surfaces move toward each other when a driving force for turning a screwthreaded member is applied through the driving means.

In various particular embodiments, the tool can include one or more of the following characteristics, taken in isolation or in any of the technically possible combinations:

- the head is designed so that the action of the driving means tends to deform the head elastically,
- the driving means for turning the head comprise an actuating member for actuating the head,
- the actuating member of the head is able to move relative to the latter in order to tend to move the contact surfaces toward each other, by lever action or by cam action on the force transmitting parts, when a driving force is applied to the actuating member to turn a screwthreaded member,
- the head has a generally H configuration and comprises two arms connected by a central web, a distal region of each arm having one of the contact surfaces and the proximal regions of the arms forming said force transmitting parts, the two arms are able to move with respect to each other by deformation of the central web in order to move the contact surfaces toward each other by separation of proximal regions of the arms, and a distal region of the actuating member is positioned between the proximal regions of the arms in order to push them apart, by lever action or by cam action, when a driving force is applied to the actuating member to turn a screwthreaded member,
- the actuating member is connected to the head by a flexible connection,
- the flexible connection comprises a deformable part formed integrally with the head and the actuating member,
- the actuating member and the head are separated or separable,
- the tool comprises removable means connecting the head to the actuating member,
- the actuating member can pivot with respect to the head,
- the actuating member is part of a torque-measuring tool,
- the tool comprises means for adjusting the tendency of the head to deform under the action of the driving means,
- the head comprises two open jaws, each of which has at least one of the contact surfaces, and
- the flexible connection is made of elastomer.

Here, the expression "head having at least two contact surfaces for turning a screwthreaded member by at least partial complementarity of form" denotes a head capable of driving such a member due to the fact that their respective shapes, which may be for example polygonal shapes, do not allow relative rotation.

In the present invention, the head also behaves functionally overall as a single piece of sufficient stiffness that, when in use, the functional geometry of the head remains essentially unchanged, except under the effect of deformation under load and the compensation of the latter according to the invention as will be described below.

BRIEF DESCRIPTION OF THE DRAWINGS

A clearer understanding of the invention will be gained from reading the following description which is given purely by way of example and refers to the accompanying drawings, in which.

DETAILED DESCRIPTION OF THE INVENTION

Figure 1:
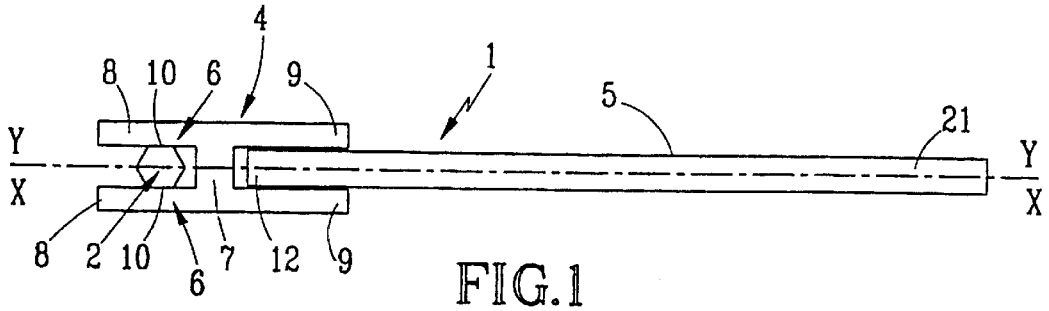
FIG. 1 is a schematic plan view of a flat open-ended wrench according to the present invention, ready to turn a nut.

FIG. 1 illustrates a flat open-ended wrench 1 ready to turn a nut 2.

The wrench 1 essentially comprises a head 4 and a separate handle 5.

The head 4, which can be made from a material with poorer properties than steel and in particular a modulus of elasticity of less than 150 gigapascals, has an H shape and comprises two straight arms 6 which are longitudinal with respect to a central axis X—X. The arms 6 are connected to each other by a central transverse web 7. Each arm 6 has on either side of the web 7 a distal end region 8 (on the left in FIG. 1), and a proximal end region 9. The web 7, which is formed integrally with the arms 6, is relatively thin and elastically deformable at least in flexion.

The distal end regions or jaws 8 each have a plane surface 10 for contact with the nut 2. The contact surfaces 10 are turned toward the inside of the head 4 and are opposite each other.

Figure 4:
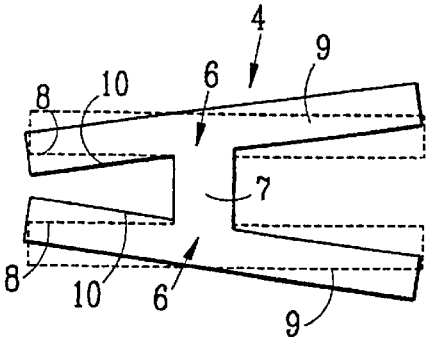
FIG. 4 is an enlarged plan view of the head of the wrench of FIGS. 1 to 3, illustrating schematically the action on the head of a relative rotation of the wrench handle.

As illustrated in exaggerated form in FIG. 4, the web 7, being able to be deformed, forms a means of turning the arms 6 with respect to each other.

Thus, the arms 6 can be rotated with respect to each other in the plane of FIGS. 1 and 4, to each side of a rest position, as shown in solid lines in FIG. 1 and in dashes in FIG. 4.

This rest position corresponds to no force being applied to the arms 6. In this position the arms are parallel with each other and parallel with the axis X—X.

The distal and proximal end regions 8, 9 can therefore be moved toward and away from each other respectively by the flexural deformation of the web 7.

In particular, the arms 6 can be moved between their rest position and a position in which their distal end regions 8 are closer together (FIG. 4) while their proximal end regions 9 are further apart.

When a screwthreaded member 2 is inserted between the distal end regions 8 of the arms 6 of the head 4, the mobility of the arms 6 is thereby limited.

The handle 5 is an elongate bar of axis Y—Y and has a slightly shorter transverse dimension than the gap between the two proximal end regions 9 of the arms 6.

The distal end region 12 of the handle 5 fits with a slight looseness between the proximal end regions 9 of the arms 6.

In the rest position shown in FIG. 1, the longitudinal axis X—X of the head 4 coincides with the longitudinal axis Y—Y of the handle 5.

The nut 2 is a hexagonal nut that fits between the distal end regions 8 of the arms 6. The contact surfaces 10 of the head 6 are alongside two opposite sides of the nut 2. The contact surfaces 10 of the head 4 make the latter partially complementary in shape to the nut 2.

Figure 2:
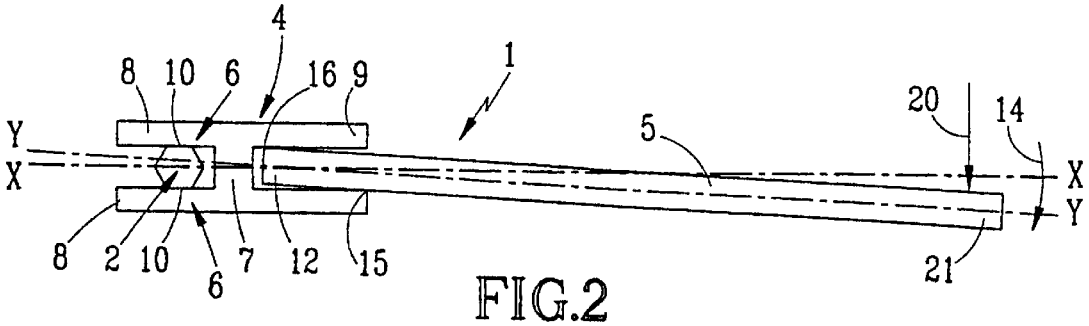
FIG. 2 and FIG. 3 are views similar to FIG. 1, illustrating the wrench when a force is applied to its handle to tighten or loosen the nut, respectively.
Figure 3:
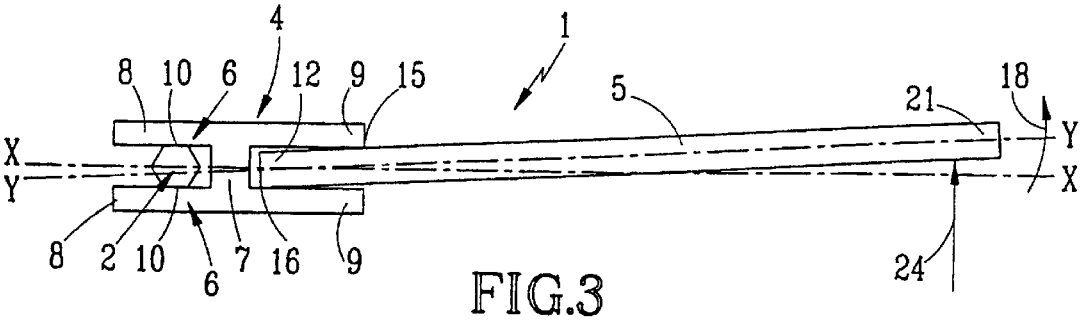

The handle 5 can be rotated with respect to the head 4 in the plane of FIG. 1, to each side of its rest position, between two positions of separation of the arms 6, one shown in FIG. 2 and the other in FIG. 3.

In FIG. 2, the handle 5 has pivoted with respect to the head 6 in the direction 14 in which the nut 2 is tightened. The distal end region 12 of the handle 5 is now pressing on a point 15 on the free end of the lower arm 6 (as viewed in FIG. 2) of the head 4, and on a point 16 close to the web 7 on the other arm 6. Points 15 and 16 are separated from each other longitudinally along the axis X—X. The axes X—X and Y—Y are therefore also inclined with respect to each other.

In the other position of separation, illustrated in FIG. 3, the handle 5 has pivoted with respect to the head 4 in the direction 18 in which the nut 2 is loosened. The distal end region 12 of the handle 5 is now pressing on a first point 15 on the upper arm 6 (as viewed in FIG. 3) of the head 4 and on a second point 16 on the other arm 6 of the head 4. The pressure points 15 and 16 therefore have a relative longitudinal position analogous to that of points 15 and 16 in FIG. 2. The axes X—X and Y—Y are therefore also inclined with respect to each other.

Operation of the wrench 1 is as follows.

When the nut 2 is to be tightened, a force 20 is applied, as illustrated in FIG. 2, to the proximal end region 21 of the handle 5, tending to pivot the latter in direction of rotation 14.

The handle 5 thus arrives at the position shown in FIG. 2 and turns the head 4 in direction 14. A tightening torque is therefore applied to the nut 2 because of the partial complementary form between the head 4 and the nut 2. The proximal end regions 9 thus form parts that transmit the force from the handle 5 to the contact surfaces 10 and therefore to the nut 2.

Simultaneously, the handle 5 is acting, via the two longitudinally offset pressure points 15 and 16, as a first-order lever and tends to drive apart the proximal end regions 9 of the arms 6 of the head 4.

In this way the distal end regions 8 of these arms 6 tend to move toward each other. This effect therefore tends to compensate for the tendency of the distal end regions 8 of the arms 6 to move apart and so limit the relative rotation of the nut 2 with respect to the head 4.

Conversely, relaxation of the force 20 on the handle 5 allows the distal end regions 8 of the arms 6 to return to the rest position.

In the same way, when a force 24 is applied to the proximal end 21 of the handle 5 to loosen the nut 2, the handle 5 moves to the position shown in FIG. 3 and tends on the one hand to drive the nut 2 in direction of rotation 18, and on the other hand to push together the distal end regions 8 of the arms 6 by lever action.

The lever action produced by the handle 5 thus tends to oppose the separation of the contact surfaces 10 by the nut 2.

As before, relaxing the force 24 on the handle 5 allows the distal end regions 8 of the arms 6 to return to the rest position.

It will thus be observed that, in both driving directions, the wrench 1 limits rotation between the nut 2 and the head 4 and also limits the risk of the head 4 breaking.

Consequently the wrench 1 is capable of transmitting larger turning forces than a conventional flat open-ended wrench, and yet the wrench 1 can access a screwthreaded member as easily as a conventional open-ended wrench.

By varying the dimensions and shape of the head 4, it is possible either only to compensate for or to limit the tendency of the contact surfaces 10 to separate, but also to overcome this tendency by a relatively large effect of closing-up of these contact surfaces 10 under the action of the handle 5. Consequently, for certain geometries of the wrench 1, within certain ranges of turning forces transmitted to a nut 2, an effect of increased clamping by the contact surfaces 10 on the nut 2 is observed when a force is applied to the handle 5.

Figure 5:
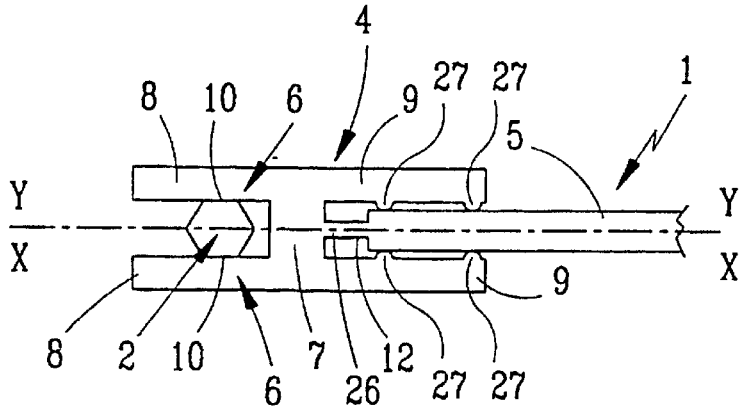
FIG. 5 and FIG. 6 are enlarged top views showing the head and distal end of the handle in two variants of the wrench of FIGS. 1 to 4.

The wrench 1 in FIG. 5 differs from that in FIGS. 1 to 4 in that the head 4 and the handle 5 are not separated but are connected by a longitudinal blade 26 formed integrally with the web 7 of the head 4 and the distal end region 12 of the handle 5.

This blade 26 can deform, for example in flexion, such that it forms, between the head 4 and the handle 5, a flexible link allowing the latter to pivot with respect to the head 4 into the positions shown in FIGS. 2 and 3.

The proximal end regions 9 of the head 4 include four internal beads 27 arranged in pairs on these regions 9. The beads 27 of a given region 9 are spaced out and are located opposite the beads 27 of the other region 9. These beads 27 form reliefs where the handle 5 presses on the proximal end regions 9 when the handle 5 is moving, with respect to the head 4, to the positions shown in FIGS. 2 and 3. It will be seen that in the rest position shown in FIG. 5, the four beads 27 are practically in contact with the handle 5.

In a variant, which is not illustrated, the blade 26 need not be formed integrally with both the head 4 and the handle 5, but welded to the head 4 and/or to the handle 5.

In a variant, which is not illustrated, the blade 26 is replaced by an additional elastomeric part, attached to both the head 4 and the handle 5 by means known per se (mechanical means or injection overmolding, for example).

Figure 6:
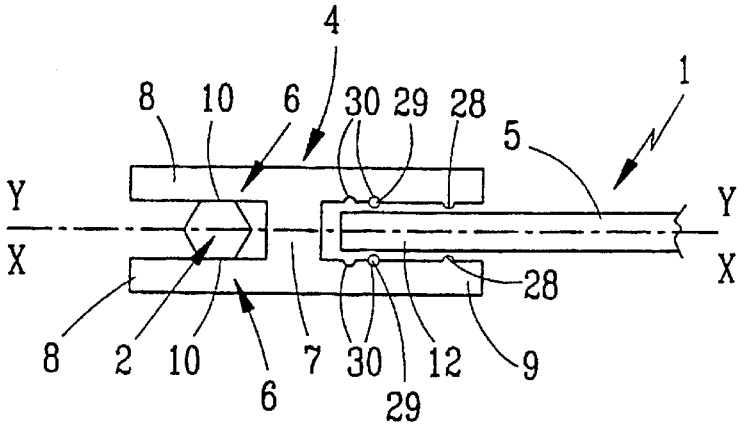

In the variant shown in FIG. 6 the head 4 comprises reliefs where the handle 5 presses against the proximal end regions 9 of the arms 6, namely a pair of beads 28 and a pair of pins 29. These reliefs project from the arms 6 toward the distal end region 12 of the handle 5.

Both the beads 28 and the pins 29 are opposite each other. However, in other variants the beads 28 and the pins 29 may be arranged differently.

The beads 28 are each formed integrally with the proximal end region 9 of an arm 6 and are further from the central web 7 than the pins 29.

The pins 29, which are cylindrical, are each housed in a recess 30 formed in the proximal end region 9 of an arm 6.

The head 4 has two pairs of recesses 30 that can house the pins 29 and are spaced apart along the axis X—X.

The spacing along the axis X—X between the pins 29 and the beads 28 can thus be modified.

The beads 28 and the pins 29 define the pressure points of the handle 5 on the head 4 so that it fulfills its lever function. By modifying the position of the pins 29, the magnitude of the tendency of the surfaces 10 to come together when a turning force is applied to a nut 2 through the handle 5 can thus be adjusted.

Thus, the smaller the spacing between the bead 28 and the pin 29 on which the handle 5 is pressing, the greater this tendency will be.

Figure 7:
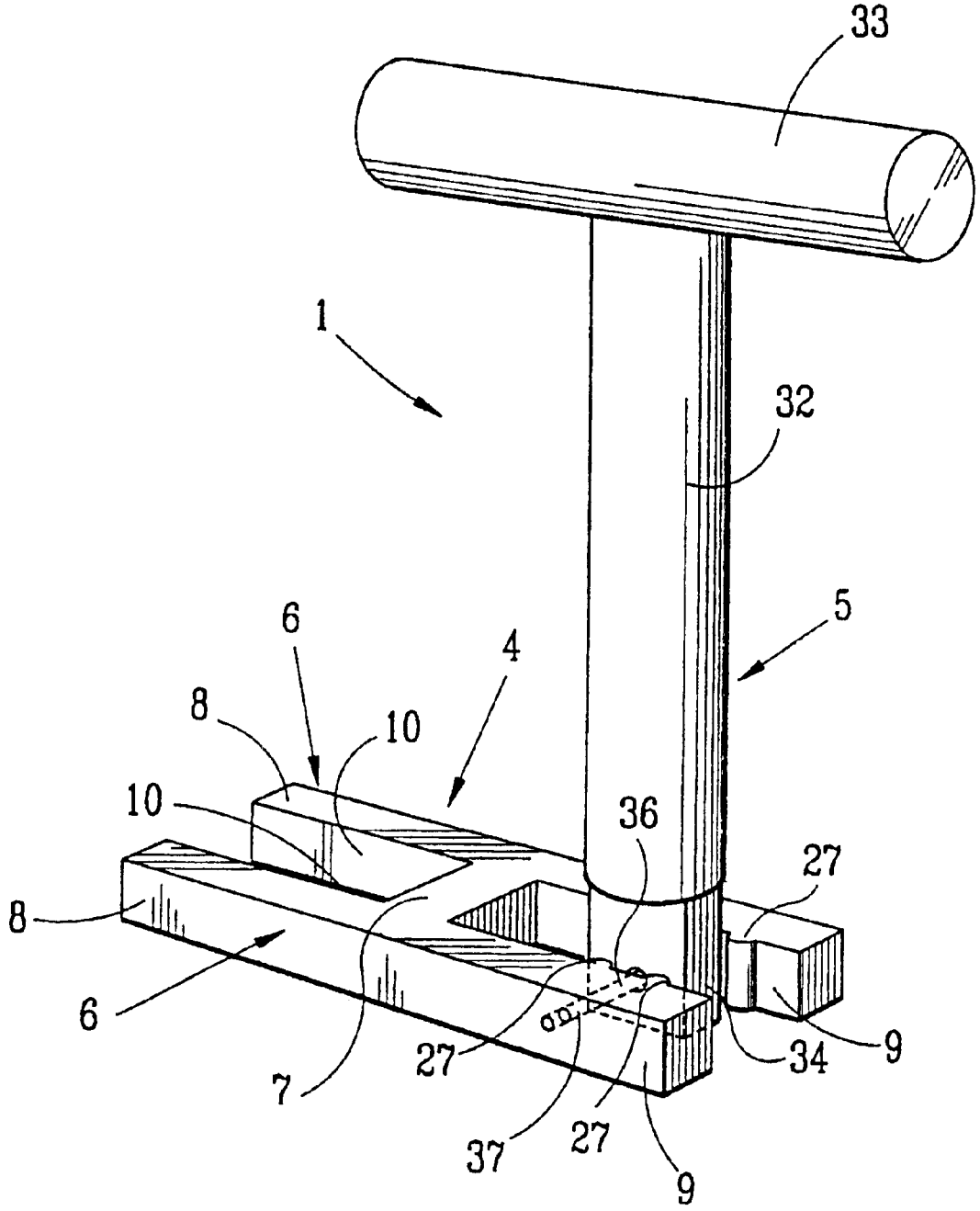
FIG. 7 is a schematic perspective view of a tool in another embodiment of the invention.

FIG. 7 illustrates another tool 1 according to the invention which differs from the wrench of FIGS. 1 to 4 in that the handle has been replaced by a T-shaped actuating member 5, which thus comprises a torque-transmitting bar 32 extended by a hand grip 33.

The distal end region 34 of the actuating member 5 fits slightly loosely between the proximal end regions 9 of the arms 6. As in FIG. 5, the proximal end regions of the head 4 have four beads 27 where the region 34 of the actuating member 5 presses on the head 4.

This region 34 is rectangular in section and contains a transverse bore 36.

A transverse hinge pin 37 passes through both arms 6 and through the bore 36.

This hinge pin 37 connects the actuating member 5 to the head 4, allowing the actuating member 5 to pivot with respect to the head 4 about the axis of the hinge pin 37.

The bar 32 can thus be positioned out of the plane of the head 4, e.g. obliquely or at right angles to this plane as shown in FIG. 7.

This ability to pivot makes it possible to adapt to varied conditions of use, e.g. for tightening nuts that are difficult to access.

The user then adapts the force that he is applying in order to always obtain a turning force on the screwthreaded member.

In addition, the play between the bore 36 and the hinge pin 37 is sufficiently great so that when, in the position shown in FIG. 7, a turning force is applied through the hand grip 33 to a nut, the bar 32 can be rotated about its longitudinal axis with respect to the head 4. The region 34 of the bar 32 then presses on the beads 27 and thus tends to push the regions 9 of the arms 6 apart by a cam action and so tends to close up the contact surfaces 10 as before.

In a variant, the hinge pin 37 can be removed to allow the head 4 and the member 5 to be separated. This allows heads 4 of different sizes and shapes to be connected to the actuating member 5.

Figure 8:
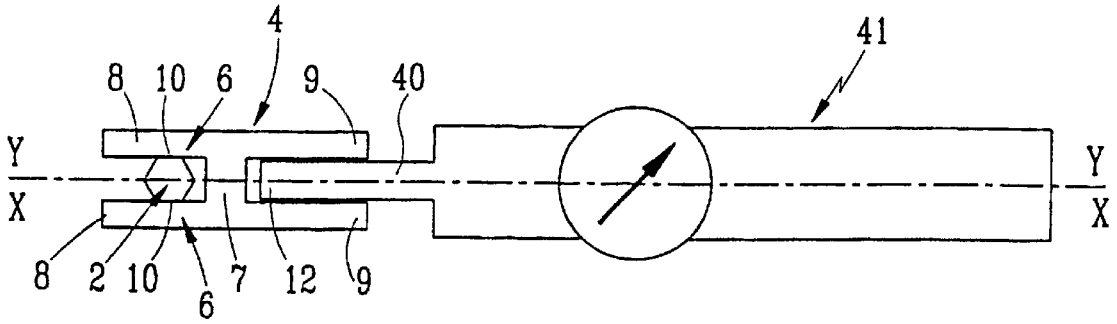
FIG. 8 is a view similar to FIG. 1 illustrating yet another embodiment of the invention.

In another embodiment shown in FIG. 8, the handle 5 of the wrench seen in FIGS. 1 to 4 has been replaced by the output end 40 of a torque wrench 41.

Although the above description is appropriate to a flat open-ended wrench, the invention can be applied to other types of tools.

What is claimed is:

1. A driving tool for turning a screwthreaded member, said driving tool comprising:

an elastically deformable head having at least two contact surfaces for rotatably driving the screwthreaded member, force transmitting parts for transmitting a turning force to the contact surfaces, and a connecting region connecting the contact surfaces, wherein the connecting region is situated between the force transmitting parts and the contact surfaces; and driving means disposed relative to the force transmitting parts so that a force, applied to the driving means, is transmitted by the force transmitting parts to the contact surfaces of the head, wherein the driving means is operable to act on the force transmitting parts to elastically deform the head so that the contact surfaces move toward each other when a driving force for turning a screwthreaded member is applied through the driving means.

2. The driving tool as claimed in claim 1, wherein the head acts as a single piece.

3. The driving tool as claimed in claim 1, wherein the driving means comprises an actuating member for actuating the head.

4. The driving tool as claimed in claim 3, wherein the actuating member is movable relative to the head in order to apply a force that acts to move the contact surfaces toward each other, by lever action or by cam action on the force transmitting parts, when a driving force is applied to the actuating member to turn the screwthreaded member.

5. The driving tool as claimed in claim 4, wherein the head defines generally an H configuration formed by two arms connected at the connecting region by a central web, wherein a distal region of each of the arms defines one of the contact surfaces and proximal regions of the arms form the force transmitting parts, wherein a distal region of the actuating member is positioned between the proximal regions of the arms in order to push them apart by lever action or by cam action, wherein, when a driving force is applied to the actuating member to turn a screwthreaded member, the central web deforms to permit the two arms to move relative to each other so that the proximal regions of the arms move away from each other and the contact surfaces move toward each other so as to at least partially conform to the shape of the screwthreaded member.

6. The driving tool as claimed in claim 3, wherein the actuating member is connected to the head by a flexible connection.

7. The driving tool as claimed in claim 6, wherein the flexible connection comprises a deformable part formed integrally with the head and the actuating member.

8. The driving tool as claimed in claim 1, wherein the driving means is separable from the head.

9. The driving tool as claimed in claim 8, wherein the driving means is connected to the head by a structure that is removable from the driving means and the head.

10. The driving tool as claimed in claim 1, wherein the actuating member can pivot with respect to the head.

11. The driving tool as claimed in claim 1, wherein driving means is part of a torque-measuring tool.

12. The driving tool as claimed in claim 1, further comprising means for adjusting the tendency of the head to deform in response to action of the driving means.

13. The driving tool as claimed in claim 1, wherein the head comprises two open jaws, each of which has at least one of the contact surfaces.

14. The driving tool as claimed in claim 6, wherein the flexible connection is made of elastomer, and the head comprises two open jaws, each of which defines at least one of the contact surfaces.

15. A driving tool for turning a screwthreaded member, said driving tool comprising:

an elastically deformable head compromising at least two contact surfaces for driving the screwthreaded member, a connecting region connecting the contact surfaces, and force transmitting parts for transmitting a turning force to the contact surfaces, wherein the head acts as a single piece when turning the screwthreaded member; and driving means for applying a turning force to the contact surfaces of the head via the force transmitting parts, wherein the connecting region is situated between the force transmitting parts and the contact surfaces, and the head is capable of elastically deforming so that the contact surfaces move toward each other when a driving force for turning a screwthreaded member is applied through the driving means, and wherein the head has a generally H configuration and comprises two arms connected by a central web at the connecting region, a distal region of each arm having one of the contact surfaces and proximal regions of the arms form the force transmitting parts, and wherein the two arms are able to move with respect to each other by elastic deformation of the central web in order to move the contact surfaces toward each other by separation of the proximal regions of the arms, and wherein a distal region of the actuating member is positioned between the proximal regions of the arms in order to push them apart, by lever action or by cam action, when a driving force is applied to the actuating member to turn a screwthreaded member.

16. The driving tool as claimed in claim 4, wherein the actuating member is connected to the head by a flexible connection.

17. The driving tool as claimed in claim 5, wherein the actuating member is connected to the head by a flexible connection.

18. The driving tool as claimed in claim 8, wherein the actuating member is pivotal with respect to the head.

19. A hand tool for turning a screwthreaded member, said hand tool comprising:

an elastically deformable head comprising at least two contact surfaces for rotatably driving the screwthreaded member, force transmitting parts for transmitting a turning force to the contact surfaces, and a connecting region connecting the contact surfaces, wherein the connecting region is located between the force transmitting parts and the contact surfaces; and an actuator associated with the force transmitting parts such that a force applied to the actuator is transmitted to the force transmitting parts to transmit a turning force to the contact surfaces of the head, wherein the actuator is operable to act directly on the force transmitting parts to elastically deform the head so that the force transmitting parts move away from each other and the contact surfaces move toward each other.

20. The hand tool as claimed in claim 19, wherein the head is an integral member and the actuator is a lever that is pivotally connected to the head.

* * * * *